US006162084A

United States Patent [19]

Chen et al.

[11] Patent Number: 6,162,084

[45] Date of Patent: Dec. 19, 2000

[54] LAMP SOCKET

[75] Inventors: Ping Chen; Kimihiro Miyake, both of Aichi, Japan

[73] Assignee: The Whitaker Corporation, Wilmington, Del.

[21] Appl. No.: 09/381,337

[22] PCT Filed: Mar. 3, 1998

[86] PCT No.: PCT/US98/04093

§ 371 Date: Sep. 17, 1999

§ 102(e) Date: Sep. 17, 1999

[87] PCT Pub. No.: WO98/42049

PCT Pub. Date: Sep. 24, 1998

[30] Foreign Application Priority Data

Mar. 17, 1997 [JP] Japan ..... 9-083303

[51] Int. Cl.[7] ..... H01R 13/625

[52] U.S. Cl. ..... 439/336; 439/616

[58] Field of Search ..... 439/610, 602, 439/611, 699.1, 699.2, 336, 731, 934, 36, 613, 616; 362/487, 263, 546; 313/318.12

[56] References Cited

U.S. PATENT DOCUMENTS 5,087,213 2/1992 Drapcho et al. ..... 439/472

5,709,450 1/1998 Francis et al. ..... 362/61

5,842,882 12/1998 Sato et al. ..... 439/336

5,897,391 4/1999 Takahashi et al. ..... 439/336

5,924,884 7/1999 Sato et al. ..... 439/336

OTHER PUBLICATIONS

Japanese Utility Model Application No. 62–64985.

Japanese Utility Model Application No. 62–64986.

*Primary Examiner*—Paula Bradley

*Assistant Examiner*—Ross Gushi

[57] ABSTRACT

The present invention provides a lamp socket which can easily be connected to a discharge lamp, and which has a high degree of safety. The lamp socket includes first and second housings which are fastened together so that the housing clamp a plurality of wires of a shielded cable, and electrical terminals which are connected to the wires. The first and second housings have main body sections which support the terminals, and extension sections which protrude from the main body sections and from which the wires extend. A shielding conductor of the shielded cable is fastened to outside surfaces of the extension sections.

10 Claims, 3 Drawing Sheets

LAMP SOCKET

FIELD OF THE INVENTION

The present invention relates to a lamp socket in which a lamp used in automobiles is connected.

BACKGROUND OF THE INVENTION

Conventionally, lamps used in automobiles have been connected to lamp sockets. Examples of lamp sockets are disclosed in Japanese Utility Model Application No. 62-64985 and Japanese Utility Model Application No. 62-64986. Such lamp sockets are electrically connected to lamp electrodes at rear ends of the lamps. Other prior art lamp sockets are disclosed in U.S. Pat. Nos. 3,982,813; 4,101,187; DE-A-4139905 and EP-A-0822626.

In recent years, high-illumination discharge (HID) lamps have been used as head lamps in automobiles. Discharge lamps are lamps in which mercury, a metal halide compound or a rare gas, such as xenon, is sealed inside the lamp. In such lamps, light is emitted by causing this substance to discharge by means of a pair of electrodes, thus realizing a high-brightness illumination with the color of sunlight. An important point in light systems using HID lamps is that a high voltage of approximately 20,000 V is required at the time that the discharge is initiated. Accordingly, a shielded cable is used as the cable connected to the lamp socket in order to prevent the generation of electromagnetic interference in other electrical circuits.

Furthermore, in the case of discharge lamps, it is necessary that the connection of the lamp be easily accomplished, and that the lamp have a high degree of safety. Generally, a discharge may occur in the air layer between terminals or conductors to which a high voltage is applied, so that there is a danger that this may be a cause of fire in parts such as connectors, etc. Accordingly, it is desirable that the terminals or conductors of the lamp socket described above be installed so that such a discharge is reliably prevented.

SUMMARY OF THE INVENTION

Thus, a feature of the present invention is to provide a lamp socket in which a discharge lamp can be easily connected, and which has a high degree of safety.

The present invention is directed to a lamp socket which receives a lamp, wherein the lamp socket includes a pair of housings which are installed so that the housings clamp electrical terminals which are connected to a plurality of wires of a shielded cable, each of the pair of housings has a main body section supporting the terminals, and an extension section used for the lead-out of wires which protrudes from the main body section, and a shielding conductor of the shielded cable is fastened to outside surfaces of the extension sections.

The lamp socket can be engaged by relative pivoting after being installed so that the lamp socket is superimposed on a discharge lamp which has been fastened to a housing or reflective mirror beforehand.

Preferably, terminal-accommodating grooves, which accommodate the electrical terminals, are formed in one of the pair of housings, and terminal-supporting ribs including engaging parts, which have dimensions that are substantially complementary to the terminal-accommodating grooves, and which substantially engage the terminals, are formed in the other housing. It is desirable that the terminal-accommodating grooves and terminal-supporting ribs be constructed so that the terminal-accommodating grooves and terminal-supporting ribs can be engaged along the direction of length of the terminals.

Preferably, wire-accommodating grooves, which accommodate the respective wires, are formed in one of the pair of housings, and wire-engaging ribs, which have dimensions that are substantially complementary to the wire-accommodating grooves, are formed in the other of the pair of housings. It is desirable that the wire-accommodating grooves and wire-engaging ribs be constructed so that the wire-accommodating grooves and wire-engaging ribs can be engaged along the direction of length of the wires.

Preferably, the fastening means used to fasten the shielding conductor is constructed so that a metal clip clamps the shielding conductor to the outside surfaces of the extension sections.

A lamp socket comprising a housing having electrical terminals disposed therein, and electrical wires of an electrical cable electrically connected to respective electrical terminals, wherein the housing includes a first housing and a second housing each of which has a main body section supporting the electrical terminals and an extension section along which the electrical wires extend, and latch members on the first housing and the second housing latching the first housing and the second housing together.

BRIEF DESCRIPTION OF THE DRAWINGS

An embodiment of the present invention will now be described by way of example with reference to the accompanying drawings in which.

DETAILED DESCRIPTION OF THE INVENTION

Figure 1:
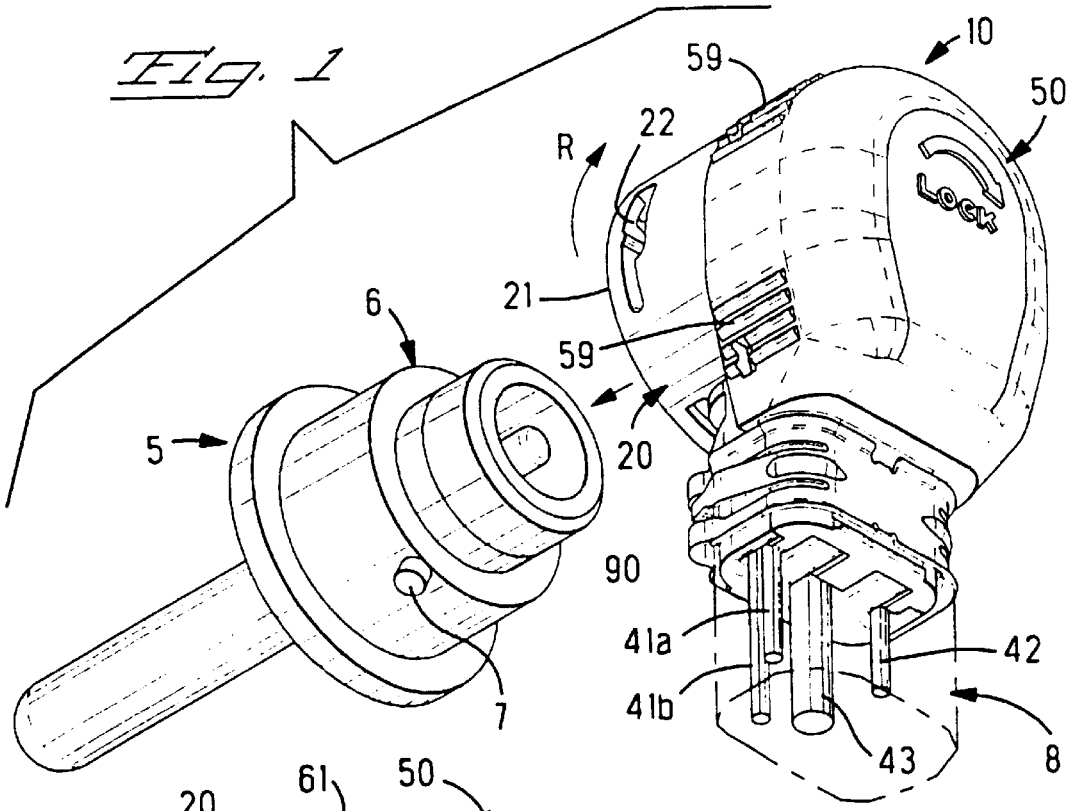
FIG. 1 is a perspective exploded view of a lamp socket of the present invention and a discharge lamp.

As shown in FIGS. 1–4, the lamp socket 10 of the present invention has first and second housings 20 and 50, and a metal clip 90. The first housing 20 has a lamp-receiving section 21 on one side. Section 21 receives a rear portion 6 of discharge lamp 5 and establishes an electrical connection between the discharge lamp 5 and the lamp socket 10. A projection 7 is located on a side surface of the rear portion 6 of the lamp 5. The lamp 5 is fastened to a housing or reflective mirror (not shown). When the lamp socket 10 is to be connected to discharge lamp 5, the lamp socket 10 is first positioned so that the lamp socket 10 is superimposed on the rear portion 6 of the discharge lamp 5; then, the lamp socket 10 is rotated relative to the discharge lamp 5. The direction of rotation is indicated by arrow R in FIG. 1. In this case, the projection 7 of the discharge lamp 5 is accommodated inside a slot 22 formed in the lamp-receiving section 21; as a result, the lamp socket 10 and discharge lamp 5 are engaged, (not shown) fastened and electrically connected together. Another projection 7 is located opposite projection 7 and it engages a slot 22 (not shown) opposite slot 22. Ribs 59, which have an anti-slip action thereby facilitating rotation of lamp socket 10, are disposed on an outside surface of the second housing 50. Ribs 59 are also disposed in symmetrical positions as viewed from behind the page, although these are not shown.

Figure 2:
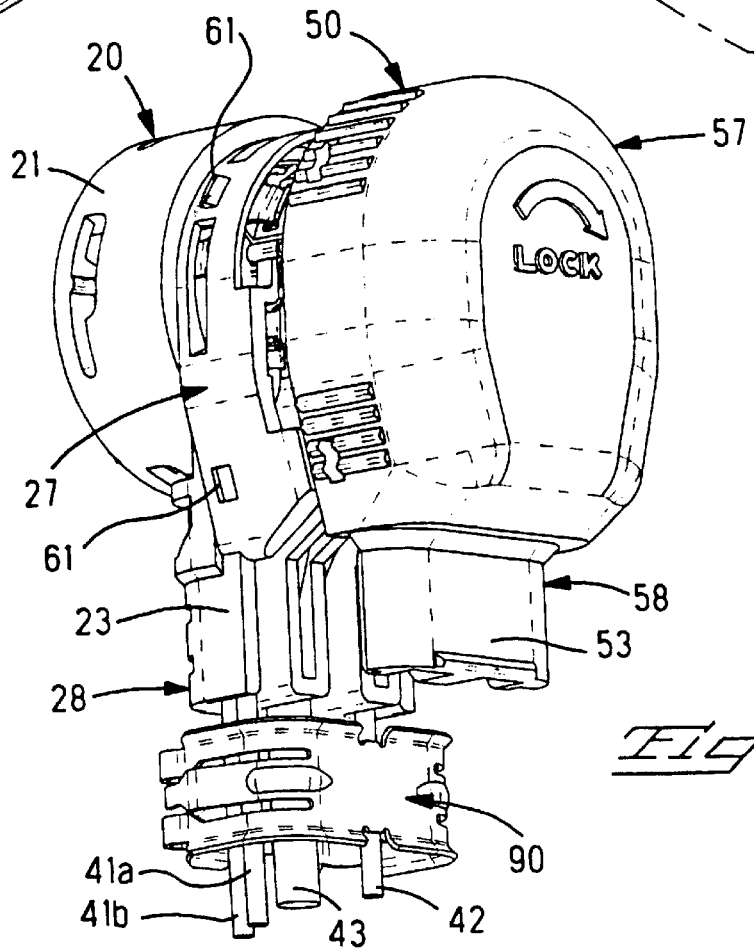
FIG. 2 is an exploded perspective view of the lamp socket shown in FIG. 1.

As is seen from FIGS. 2–4, the first and second housings 20, 50 respectively have main body sections 27, 57 which support the terminals (described later), and extension sections 28, 58 which extend in the direction in which the wires extend from lamp socket 10. The extension sections 28, 58 respectively have substantially flat outside surfaces 23, 53 which form a continuous surface when the first and second housings 20, 50 are combined as a socket.

Figure 3:
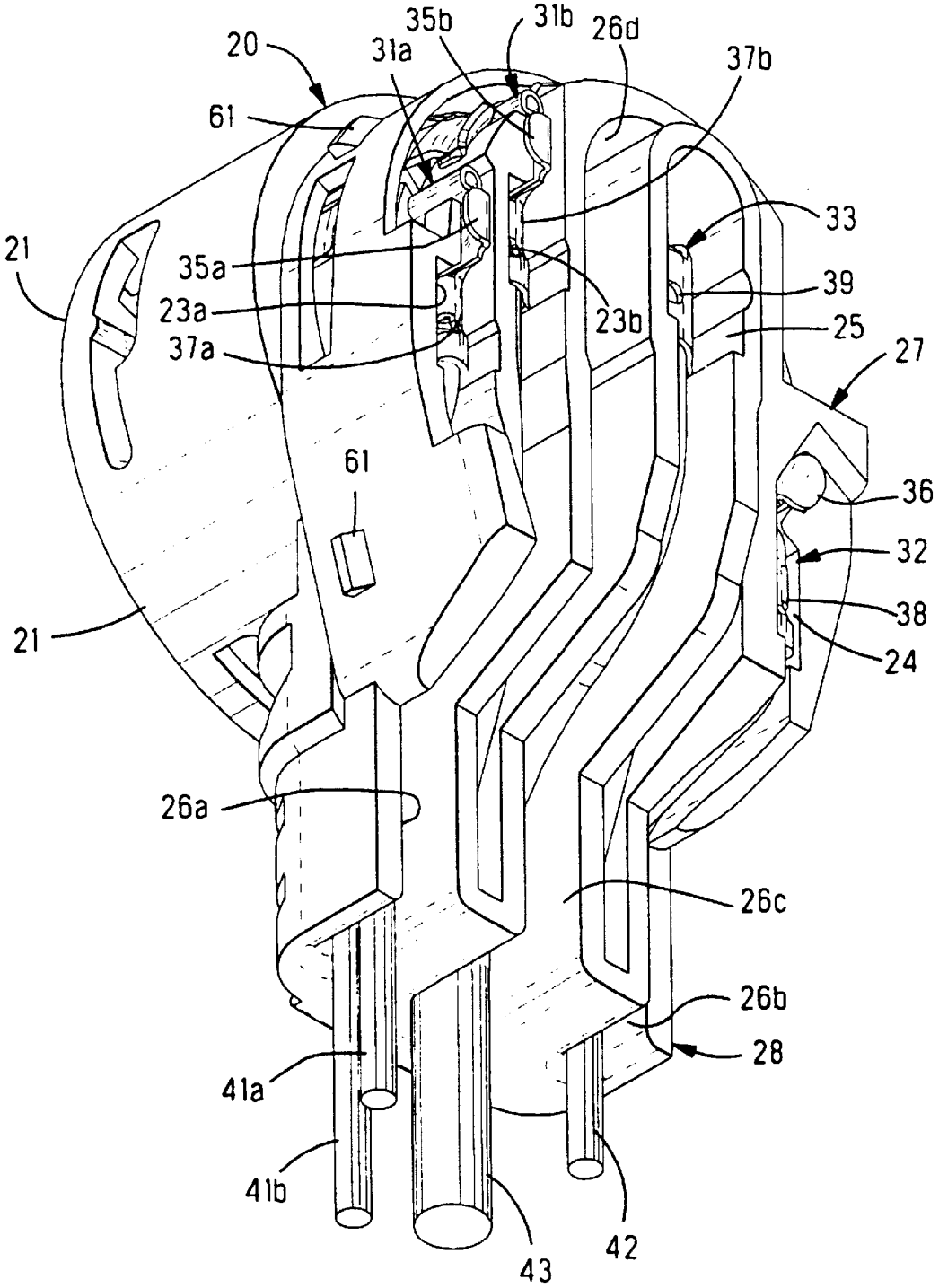
FIG. 3 is a perspective view which shows a plurality of electrical terminals to which electrical wires are connected accommodated in the first housing used in the lamp socket shown in FIG. 1.

As shown in FIG. 3, terminal-accommodating grooves 23*a*, 23*b*, 24, 25, which separately accommodate respective electrical terminals 31*a*, 31*b*, 32, 33, and wire-accommodating grooves 26*a*, 26*b*, 26*c*, which accommodate four wires 41*a*, 41*b*, 42 and 43, that are electrically connected to the respective terminals 31*a*, 31*b*, 32, 33 by crimping, are formed in the opposite side of the first housing 20 from the engagement section 21. Central wire 43 is a relatively large diameter wire to which high voltage is supplied. Wire-accommodating groove 26*a* is formed so that it accommodates two relatively small diameter wires 41*a*, 41*b*. Specifically, the terminal-accommodating grooves 23*a*, 23*b* communicate with the wire-accommodating groove 26*a*, and the terminal-accommodating grooves 24, 25 respectively communicate with the wire-accommodating grooves 26*b*, 26*c*. As shown, the wire-accommodating grooves 26*a*–26*c* extend as continuations into extension section 28 from the main body section 27. It should be noted that a substantially U-shaped groove 26*d* is formed around the periphery of the terminal-accommodating groove 25 and wire-accommodating groove 26*c* which accommodate the central terminal 33 and wire 43. The groove 26*d* also continues into the extension section 28 from the body section 27.

Figure 4:
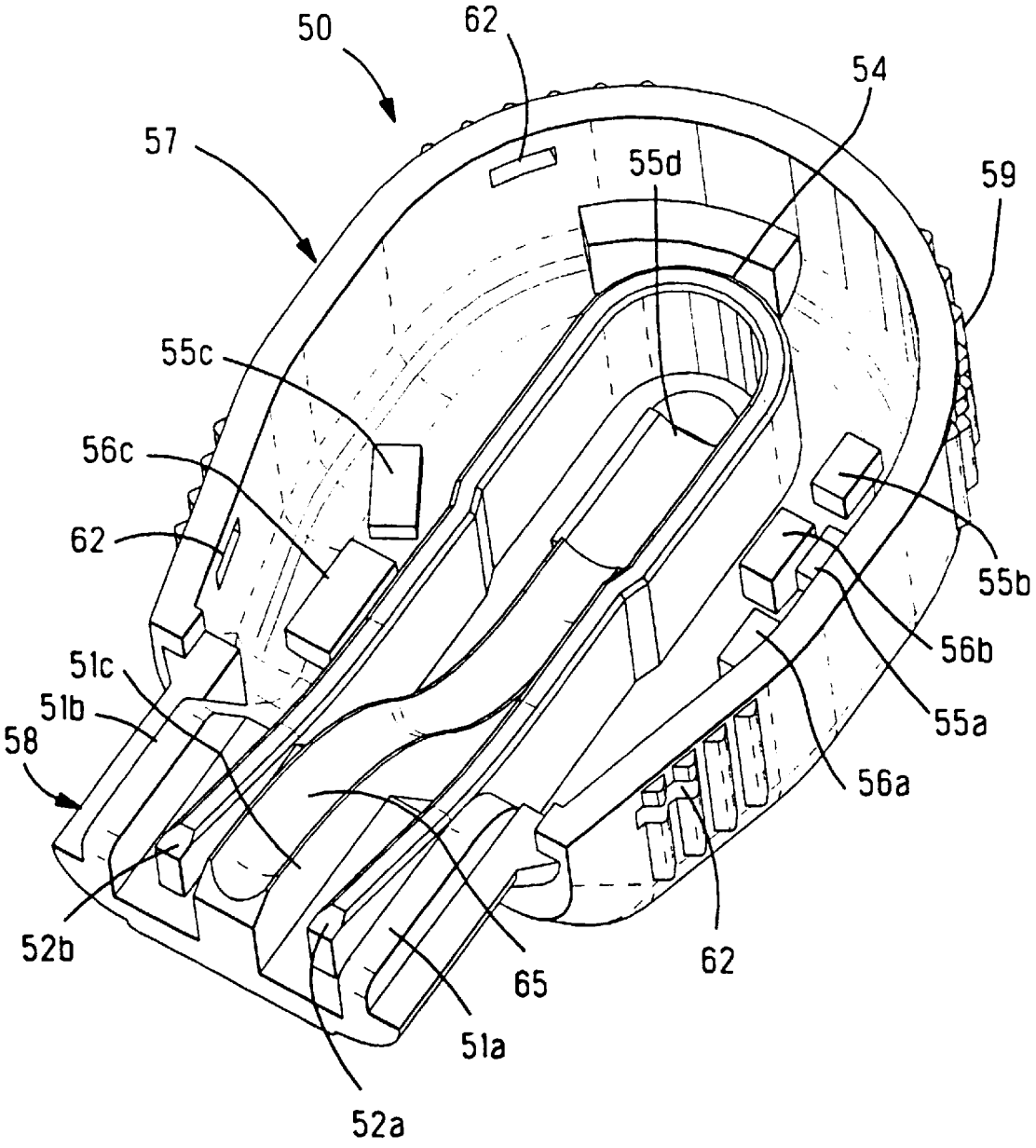
FIG. 4 is a perspective view which illustrates the inside structure of the second housing used in the lamp socket shown in FIG. 1.

As shown in FIG. 4, a substantially U-shaped wall 54, which protrudes for a bottom wall, and a plurality of projections 55*a*–55*d* and 56*a*–56*c* which also protrude from the bottom wall are located to the inside and outside of the wall 54, and they are located on the inside of the main body section 57 of the second housing 50. The substantially U-shaped wall 54 has a shape which is complementary to that of the substantially U-shaped groove 26*d*. Ribs 51*a*–51*c* are located on an inside surface of the extension section 58 of the second housing 50 in positions corresponding to the wire-accommodating grooves 26*a*–26*c*, and ribs 52*a*, 52*b* are located in positions corresponding to the groove 26*d*. The rib 51*c* is formed with a relatively large dimension. A recess 65 is formed in the rib 51*c* in a position corresponding to the location of wire 43.

When he first and second housing 20, 50 are assembled as shown in FIG. 1, both housings are fastened or latched together by engagement of the projections 61 of the first housing 20 within the rectangular slots 62, which pass through the second housing 50 and are in alignment with projections 61. In this case, the wall 54 of the main body section 57 of the second housing 50 and the ribs 52*a*, 52*b* of the extension section 58 engage with the groove 26*d* of the first housing 20 so that these parts interengate. As was described above, the wire 43 and terminal 33 are used to supply a high voltage. As a result of the above construction, the surface distance from the wire 43 and terminal 33 to the other wires and terminals is lengthened, so that the occurrence of electrical discharges is prevented.

Once again as shown in FIG. 3, the terminals 31*a*, 31*b*, 32 are disposed so that plate sections 35*a*, 35*b* and 36, formed by bending, and crimping sections 37*a*, 37*b* and 38 of terminals 31*a*, 31*b*, 32 face to the rear. Furthermore, the terminal 33 is disposed so that a crimping section 39 faces to the rear. The terminals 31*a*, 31*b*, 32, 33 respectively terminate wires 41, 41*b*, 42, 43 in the crimping sections 37*a*, 37*b*, 38, 39 in the direction of length of the connected wires 41*a*, 41*b*, 42, 43. When the first and second housings 20, 50 are assembled, the projections 55*a*–55*d* substantially engage the respective crimping sections 37*a*, 37*b*, 38, 39 of the terminals 31*a*, 31*b*, 32, 33. Furthermore, the projections 56*a*–56*c* substantially engage the respective plate sections 35*a*, 35*b*, 36 of the terminals 31*a*, 31*b*, 32. As a result, the terminals 31*a*, 31*b*, 32, 33 are supported so that the terminals are clamped between the first and second housings 20, 50.

Furthermore, when the first and second housings 20, 50 are assembled, the ribs 51*a*–51*c* of the extension section 58 of the second housing 50 are engaged and accommodated in the wire-accommodating grooves 26*a*–26*c* of the extension section 28 of the first housing 20. As a result, the accommodated wires 41*a*, 41*b*, 42, 43 are supported inside the wire-accommodating grooves 26*a*–26*c*, and strain relief action is effected on the wires.

The four wires 41*a*, 41*b*, 42, 43 described above extend from a single shielded cable and are disposed inside a shielding conductor or braided wire 8. Shielding conductor 8 is subjected to a termination operation after the first and second housings 20, 50 have been fastened together. The shielding conductor 8 is indicated by broken lines in FIG. 1. The shielding conductor 8 is installed on the continuous outside surfaces 23, 53 of the extension sections 28, 58 of the first and second housings 20, 50 and is fastened in place by being clamped thereon by the metal clip 90. Metal clip 90 is deformed and firmly fastens the shielding conductor 8 in place along extension sections 28, 58 (FIG. 1). Since this shielding conductor 8 is fastened in place on the outside of housings 20, 50 in a position sufficiently separated from the terminal 33 and wire 43 to which a high voltage is applied, there is no danger of discharge.

It was noted above that the engagement and fastening of the lamp socket 10 and discharge lamp 5 are accomplished by rotating the lamp socket 10 relative to the discharge lamp 5, and that this operation is accomplished by gripping ribs 59 on the second housing 50 and rotating lamp socket 10. In this case, as a result of the engagement of the wall 54 and ribs 52*a*, 52*b* of the second housing 50 with the groove 26*d* in the first housing 20, and the engagement of the ribs 51*a*–51*c* of the extension section 58 of the second housing 50 with the wire-accommodating grooves 26*a*–26*c*, the rotational force applied to the second housing 50 during this rotational operation can be effectively transmitted to the first housing 20. Furthermore, the external shape of the housing of the lamp socket 10 is a shape in which relatively small extension sections 28, 58 protrude from the main body sections 27, 57 as integral parts thereof. Accordingly, even if the fingers of the operator gripping the housing during the rotational operation catch on the extension sections 28, 58 of the housings 20, 50, the rotational force is effectively transmitted to the housings 20, 50 via the extension sections 28, 58, and no loosening of the fastening of the shielding conductor 8 to extension sections 28, 58 during the rotational operation takes place.

A lamp socket of the present invention has been described above; however, it is merely an example, and does not limit the present invention. Various modifications and alterations may be made by a person skilled in the art. For example, the fastening of the shielding conductor 8 could also be accomplished by means of a tape instead of the metal clip 90 described above. In such a case, the tape may be either conductive or non-conductive.

The lamp socket of the present invention includes first and second housings which are latched together so that the housings clamp electrical terminals therein which are connected to a plurality of electrical wires of a shielded cable. Furthermore, each of the first and second housings has a main body section which supports the terminals and an extension section for the wires which extend from the main body section, and a shielding conductor of the shield cable is fastened to the outside surfaces of the extension sections. Accordingly, a lamp socket which allows easy connection to a discharge lamp, and which has a high degree of safety, is obtained. In particular, since the shielding conductor is securely connected in place on the outsides of the housings in a position sufficiently separated from a terminal and wire to which a high voltage is applied, there is no danger of electrical discharge. Moreover, even if fingers of the operator should catch on the extension sections during the engagement and connection of the lamp socket to a discharge lamp, no loosening of the connection of the shielding conductor to the socket occurs. Accordingly, a high degree of safety is obtained when using the lamp socket of the present invention.

What is claimed is:

1. A lamp socket comprising a housing (20, 50) having electrical terminals (31*a*, 31*b*, 32, 33) disposed therein, and electrical wires (41*a*, 41*b*, 42, 43) of an electrical cable electrically connected to respective electrical terminals, characterized in that the housing includes a first housing (20) and a second housing (50), the first housing and the second housing has a main body section (27, 57) supporting the electrical terminals (31*z*, 31*b*, 32, 33) and an extension section (28, 58) along which the electrical wires (41*a*, 41*b*, 42, 43) extend, and latch members (61, 62) on the first housing and the second housing latching the first housing and the second housing together, and wherein the extension section (28, 58) of said first housing (20) and said second housing (50) is continuous for receipt of a shielding conductor (8) of the electrical cable, and a metal clip (90) clamping the shielding conductor (8) onto the extension section (28, 50).

2. A lamp socket as claimed in claim 1, wherein the first housing (20) has a lamp-receiving section (21) in which a discharge lamp (5) is received.

3. A lamp socket as claimed in claim 1, wherein said main body section (27) of said first housing (20) includes terminal-accommodating grooves (23*a*, 23*b*, 24, 25) in which respective electrical terminals (31*a*, 31*b*, 32, 33) are disposed.

4. A lamp socket as claimed in claim 3, wherein said extension section (28) of said first housing (20) includes wire-accommodating grooves (26*a*, 26*b*, 26*c*) along which respective electrical wires (41, 41*b*, 42, 43) extend.

5. A lamp socket as claimed in claim 4, wherein said extension section (58) of said second housing (50) includes ribs (51*a*, 51*b*, 51*c*) for disposition within the respective wire-accommodating grooves (26*a*, 26*b*, 26*c*) for engagement with the respective electrical wires (41*b*, 42, 43) disposed therein.

6. A lamp socket as claimed in claim 3, wherein said main body section (57) of said second housing (50) includes projections (55*a*–55*d*) extending from a bottom wall of said main body section (57) for engagement with respective crimping sections (31*a*, 37*b*, 38, 39) of said electrical terminals (31*a*, 31*b*, 32, 33).

7. A lamp socket as claimed in claim 6, wherein said main body section of said second housing (50) includes other projections (56*a*, 56*b*, 56*c*) extending from the bottom wall of said main body section (57) for engagement with respective plate sections (35*a*, 35*b*, 36) of said electrical terminals (31*a*, 31*b*, 32).

8. A lamp socket as claimed in claims 3 and 4, wherein said main body section (27) of said first housing (20) includes a U-shaped groove (26*d*) extending around the terminal-accommodating groove 25 and the wire-accommodating groove (26*c*) which accommodates electrical terminal (33) and electrical wire (43).

9. A lamp socket as claimed in claim 6, wherein said main body, section (57) of said second housing (50) includes a U-shaped wall (54) extending from a bottom wall of said main body section (57), said U-shaped wall (54) being disposed within said U-shaped groove (26*d*).

10. A lamp socket as claimed in claim 9, wherein said electrical wire (43) is a high voltage wire and the interengaged U-shaped groove (26*d*) and U-shaped wall (54) thereby lengthening the distance from the electrical terminal (33) and electrical wire (43) to the other electrical terminals (31*a*, 31*b*, 32) and electrical wires (41*a*, 41*b*, 42).

* * * * *